US006170214B1

(12) United States Patent
Treister et al.

(10) Patent No.: US 6,170,214 B1
(45) Date of Patent: Jan. 9, 2001

(54) CLADDING SYSTEM

(76) Inventors: Kenneth Treister, 3660 Battersea Rd., Miami, FL (US) 33135; Yehuda Mizrahi, Kadem St. 17/81, Jerusalem (IL), 97229

( * ) Notice: Under 35 U.S.C. 154(b), the term of this patent shall be extended for 0 days.

(21) Appl. No.: 09/094,385

(22) Filed: Jun. 9, 1998

(51) Int. Cl.[7] ..... E04B 2/88

(52) U.S. Cl. ..... 52/511; 52/235; 52/506.08; 52/506.09; 52/586.1; 52/763

(58) Field of Search ..... 52/235, 506.09, 52/511, 513, 586.1, 763, 506.08

(56) References Cited

U.S. PATENT DOCUMENTS

| | | | | |
|---|---|---|---|---|
| 4,483,122 | * | 11/1984 | Crandell | 52/235 X |
| 4,685,263 | * | 8/1987 | Ting | 52/235 |
| 5,155,958 | * | 10/1992 | Huff | 52/235 |
| 5,301,484 | * | 4/1994 | Jansson | 52/235 |
| 5,673,529 | * | 10/1997 | Treister et al. | 52/511 |

* cited by examiner

*Primary Examiner*—Christopher T. Kent
(74) *Attorney, Agent, or Firm*—Malloy & Malloy, P.A.

(57) ABSTRACT

A cladding system used to secure a cladding material panel to a building structure and including upper and lower bracket members to cooperatively and respectively engage upper and lower ends of adjacent cladding material panels. The upper bracket member includes a first fastener member to engage an interior surface of a first cladding material panel and a second fastener member a spaced apart distance therefrom and also engaging the first cladding material panel. A mount assembly secures the upper bracket member a spaced apart distance from the building structure and facilitates alignment of the cladding material panels. The lower bracket member includes a first lower fastener member to engage a second cladding material panel and a second lower fastener member a spaced apart distance therefrom which also engages the second cladding material. A coupling assembly secures the upper and lower bracket members in aligned relation with one another such that an exterior surface of the first cladding material panel secured by the upper bracket member is generally aligned with an exterior surface of the second cladding material panel secured by the lower bracket member.

38 Claims, 4 Drawing Sheets

CLADDING SYSTEM

BACKGROUND OF THE INVENTION

1. Field of the Invention

The present invention relates to a cladding system utilized to suspend a plurality of cladding material panels, such as stone or marble material panels, from a surface of a building structure so as to achieve a decorative and uniform exterior appearance. The cladding system is highly versatile for use with strong, thick cladding material panels as well as thinner or more fragile cladding material panels and provides an easy to install uniform and aligned exterior surface appearance without compromising security and stability.

2. Description of the Related Art

Despite the fact that the general surface construction of most building structures has remained constant throughout the years, the exterior appearance given to building structures is a matter of constant architectural upgrading and variation as different systems and looks become popular. One such popular exterior surface appearance to building structures, and especially taller building structures, relates to the utilization of cladding material panels, such as from stone, granite or marble to cover the exterior surface of the building structure. While these cladding material panels could certainly be bolted directly to the exterior surface of the building structure, aesthetic requirements necessitate that whatever suspension structure is utilized to support the cladding material panels in place be configured to be concealed and thereby preserve an attractive and uniform exterior appearance between adjacent cladding material panels. To this end, a number of different cladding systems have been provided so as to suspend the cladding materials on the exterior surface of a building structure.

A most common type of cladding system utilized in the present art involves the utilization of a plurality of pegs or clips that extend into the upper and lower edges of each material panel. In particular, these clips or pins generally include an L or T-shaped construction which extends into a notch defined in a corresponding edge of the cladding material panel. Typically, two or more of these pins are utilized and are spaced along the upper and lower surfaces of the cladding material panels providing the primary means of support for each cladding material panel. Of course, such existing pin type cladding systems have a substantial number of attendant drawbacks associated with their use.

In particular, a primary difficulty associated with the conventional pin type cladding material type fastener is the fact that each pin concentrates the loads exerted thereby at a single point along the surface of the panel, and indeed, concentrates a break point or tension point of the material panel into the notch defined therein. As a result, because the notch is typically formed at a mid-point in the thickness of the cladding material panel, only approximately one half of the strength of the cladding material panel's thickness resists breakage at the location of the pins and indeed secures the panels in place. Moreover, such cladding material panels are very difficult to align based upon surface contours at the building structure. For example, if a securement point for a particular cladding material panel happens to be a weak point in a surface of the building structure, a user must none the less secure the pin at that point as no modification of the fastening point along the edge of the cladding material panel can be made on site, and no modification in the direction or the location of engagement with the wall surface can be made on site. Furthermore, if surface contours vary from place to place on the exterior surface of the building structure, as is often the case when covering existing building structures, the precise positioning and orientation of the adjacently positioned cladding material panels may need to be varied. Presently, the existing pin designs, if they are structured so as to accommodate securement of adjacent panels, do not provide any adjustability, such as for spacing between the panels and/or for spacing relative to a wall structure of the building.

Additionally in the art are other cladding systems, such as that developed by the present inventor in issued U.S. Pat. No. 5,673,529. Such systems are typically configured to provide for single panel securement and include alternative structures which do not allow for the adaptability and the adjustability of the present invention regarding the alignment and hanging of adjacent cladding material panels.

As a result, there is a substantial need in the art for a cladding system which will maintain adjacent cladding material panels securely in place in a substantially adjustable alignable manner relative to one another. Furthermore, such a cladding system should be substantially secured and stable, regardless of surface contours in the surface of the building structure and/or weak points in the surface of the building structure, and should maximizing the grip of the cladding system on the material panels, thereby permitting a variation in the style and nature of the cladding material panels utilized to include thinner more fragile material panel that would normally not have been usable in conventional cladding systems. Also, there is a need for a cladding system which provides increased stability and security between a cladding material panel and the surface of the building structure so as to prevent possible breakage and/or detachment of the cladding material panel from its secured position under adverse environmental condition, such as hurricanes and earthquakes.

SUMMARY OF THE INVENTION

The present invention is directed towards a cladding system utilized to secure a cladding material panel to a surface of a building structure. The cladding system includes primarily an upper bracket member and a lower bracket member structured to cooperatively and respectively engage and suspend first and second cladding material panels. In particular, the upper bracket member is structured to cooperatively engage an upper end of a first cladding material panel, while the lower bracket member is structured to cooperatively engage a lower end of a second cladding material panel disposed in generally adjacent relation above the first cladding material panel.

Looking particularly to the upper bracket member, it includes a first fastener member and a second fastener member. The first fastener member is structured to supportably engage an interior surface of the first cladding material at a point generally adjacent the upper end thereof, and thereby secure and support the first cladding material panel. Additionally, the second fastener member is disposed a spaced apart distance from the first fastener member and extends at least partially into engaging relation with the cladding material panel at the upper end thereof. As a result, the first and second fastener members will supportably retain and maintain the upper end of the first cladding material panel, generally therebetween.

The upper bracket member is further structured to be secured to the surface of the building structure by a mount assembly. The mount assembly maintains the upper bracket member in a generally spaced apart relation from the surface of the building structure thereby facilitating alignment of the first cladding material panel relative to the surface of the building structure, as necessary to correspond the particular shape and/or contour of the building structure.

Much like the upper bracket member, the lower bracket member includes a first lower fastener member and a second lower fastener member. The first lower fastener member is structured to supportably engage an interior surface of the second cladding material panel at a point generally adjacent its lower end. Further, the second lower fastener member is disposed a spaced apart distance from the first lower fastener member and is structured to extend at least partially into engaging relation with the second cladding material panel at the lower end thereof. As a result, the first and second lower fastener members of the lower bracket member supportably retain the lower end of the second cladding material panel.

The cladding system further includes a coupling assembly. In particular, the coupling assembly is structured to secure the upper and lower bracket members in substantially secure, preferably generally overlying relation with one another so that an exterior surface of the first cladding material panel is generally aligned with an exterior surface of the second cladding material panel. In this regard, the coupling assembly preferably includes a retention channel and a lock segment which cooperatively engage one another so as to secure the upper and lower bracket members in aligned relation with one another and with a mount assembly. As a result, the first of the second cladding material panels are secured in aligned relation with one another. Furthermore, from the preceding it is seen that the upper bracket member of one cladding system cooperates with the lower bracket member of an other cladding system disposed thereabove so as to retain a corresponding cladding material panel in sandwiched relation therebetween. Each particular cladding system, however, is generally disposed between adjacently disposed cladding material panels and thereby cooperatively supports both cladding material panels in aligned relation with one another and in cooperation with further, spaced apart cladding systems.

It is an object of the present invention to provide a cladding system structured to securely maintain cladding material panels fastened to a surface of the building structure in a substantially aligned and aesthetically pleasing manner.

A further object of the present invention is to provide a cladding system capable of aligning adjacent cladding material panels to one another and securing the adjacent cladding material panels to a building structure in a manner which maintains the required alignment.

Another object of the present invention is to provide a cladding system which maximizes a secure engagement thereof with a cladding material panel and maximizes a strength and thickness of the cladding material panel at a stress point from the forces exerted thereon by the engagement of the cladding system.

An additional object of the present is to provide a cladding system which remains concealed while securely maintaining the cladding material panel in place, and is capable of variably spacing adjacent cladding material panels from one another and/or providing a generally flushed type engagement therebetween.

Also an object of the present invention is to provide a cladding system which resists pivotal movement of adjacent cladding material panels towards one another that would tend to mis-align the adjacent cladding material panels when a spacing therebetween is desired.

Yet another object of the present invention is to provide a cladding system which can be securely fastened to a surface of a building structure without modification or addition, regardless of certain points of weakness on the surface of the building structure.

A further object of the present invention is to provide a cladding system which can be adjusted in a horizontal and vertical plane relative to the surface of the building structure to which it is secured.

An object of the present invention is to provide a cladding system which permits the use of thin or generally more fragile cladding material panels in a manner which nonetheless maintains a secure engagement and utilization thereof on a building structure, and indeed equates a strength and resistance to breaking of these weaker panels to that of thicker panels used in conventional systems.

These and other objects will become apparent from the following claims and the accompanying specification.

BRIEF DESCRIPTION OF THE DRAWINGS

For a fuller understanding of the nature of the present invention, reference should be had to the following detailed description taken in connection with the accompanying drawings in which.

Like reference numerals refer to like parts throughout the several views of the drawings.

DETAILED DESCRIPTION OF THE PREFERRED EMBODIMENT

Figure 1:
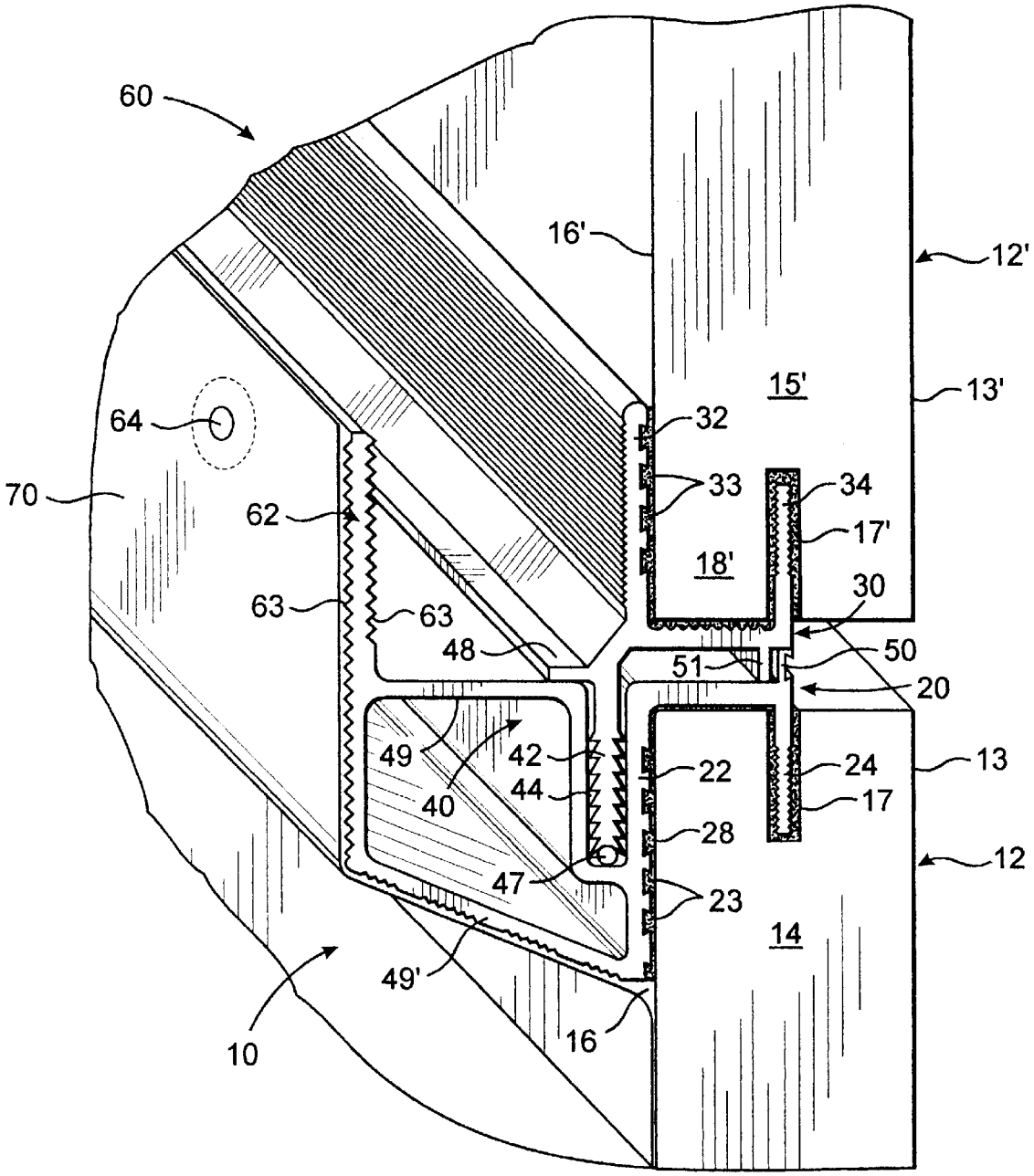
FIG. 1 is a partial perspective illustration of the cladding system of the present invention.

The present invention is directed towards a cladding system, generally indicated as 10. In particular, the cladding system 10, and preferably a plurality of cladding systems are utilized to secure a cladding material panel 12, 12' to a surface 101 of a building structure 100. Preferably, the cladding material panels 12, 12' are constructed of stone or another rigid and decoratively attractive material, such as a marble, granite or the like, so as to cover an exterior surface 101 of a building structure 100 and provide an attractive, uniform, aesthetic appearance. To this end, a plurality of cladding material panels, 12, 12' are usually incorporated and are preferably disposed in generally adjacent relation with one another so as to substantially cover the building structure 100. Indeed, the particular layout, pattern and orientation, including but not limited to the specific spacing between adjacent cladding material panels 12 and 12' will vary depending upon the architectural needs and designs of a particular builder and the overall aesthetic appearance desired. Furthermore, the types of material which can be utilized to define the cladding material panels 12, 12' may be varied, mixed and/or integrated, and indeed the cladding system 10 of the present invention is specifically structured so as to permit more fragile materials and/or thinner cut panels, as is especially helpful with more expensive materials, to be utilized and to be securely retained and positioned by the cladding system 10.

Figure 3:
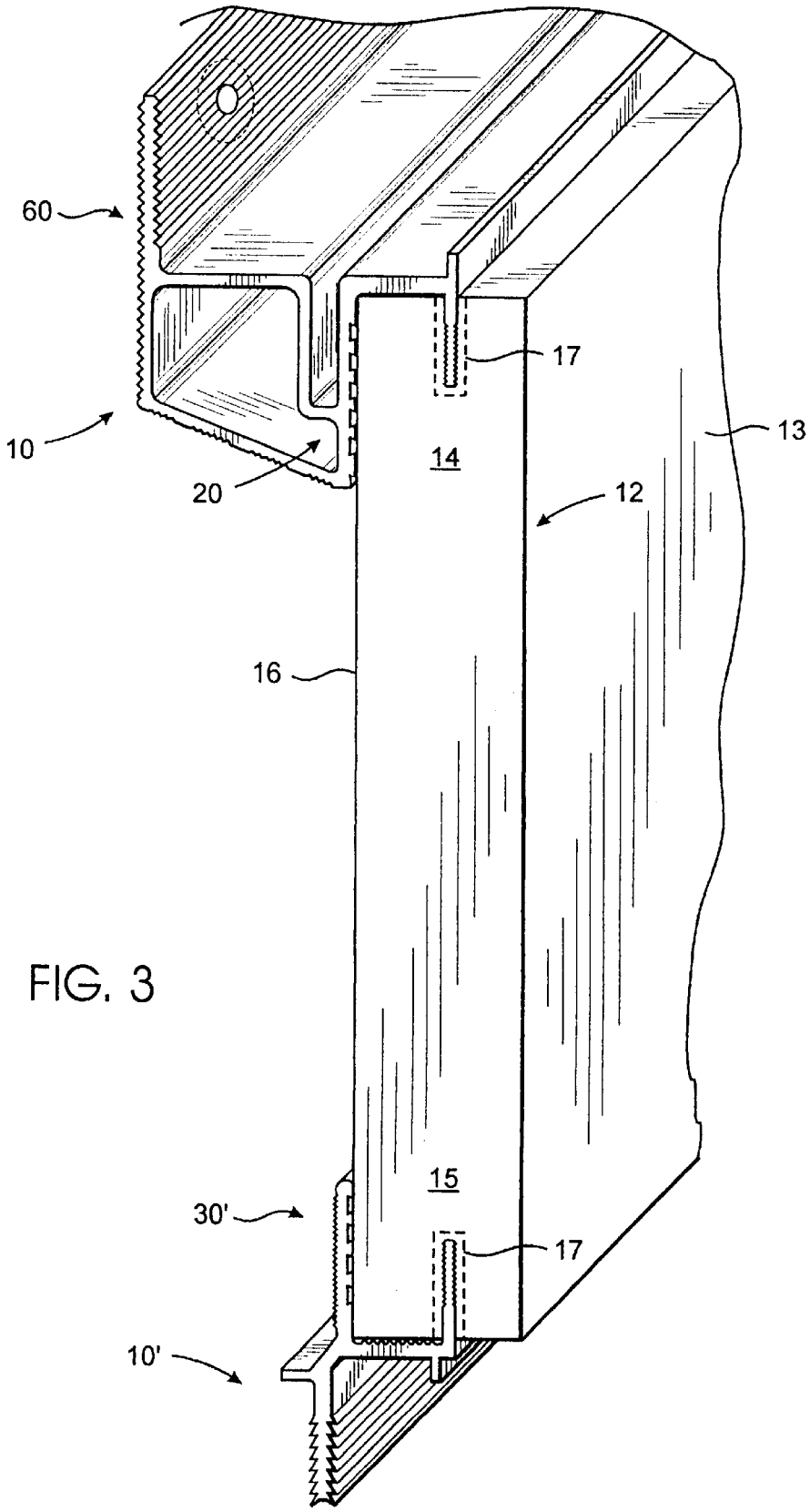
FIG. 3 is a partial perspective view of a cladding material panel in operative engagement with cladding systems of the present invention.
Figure 4:
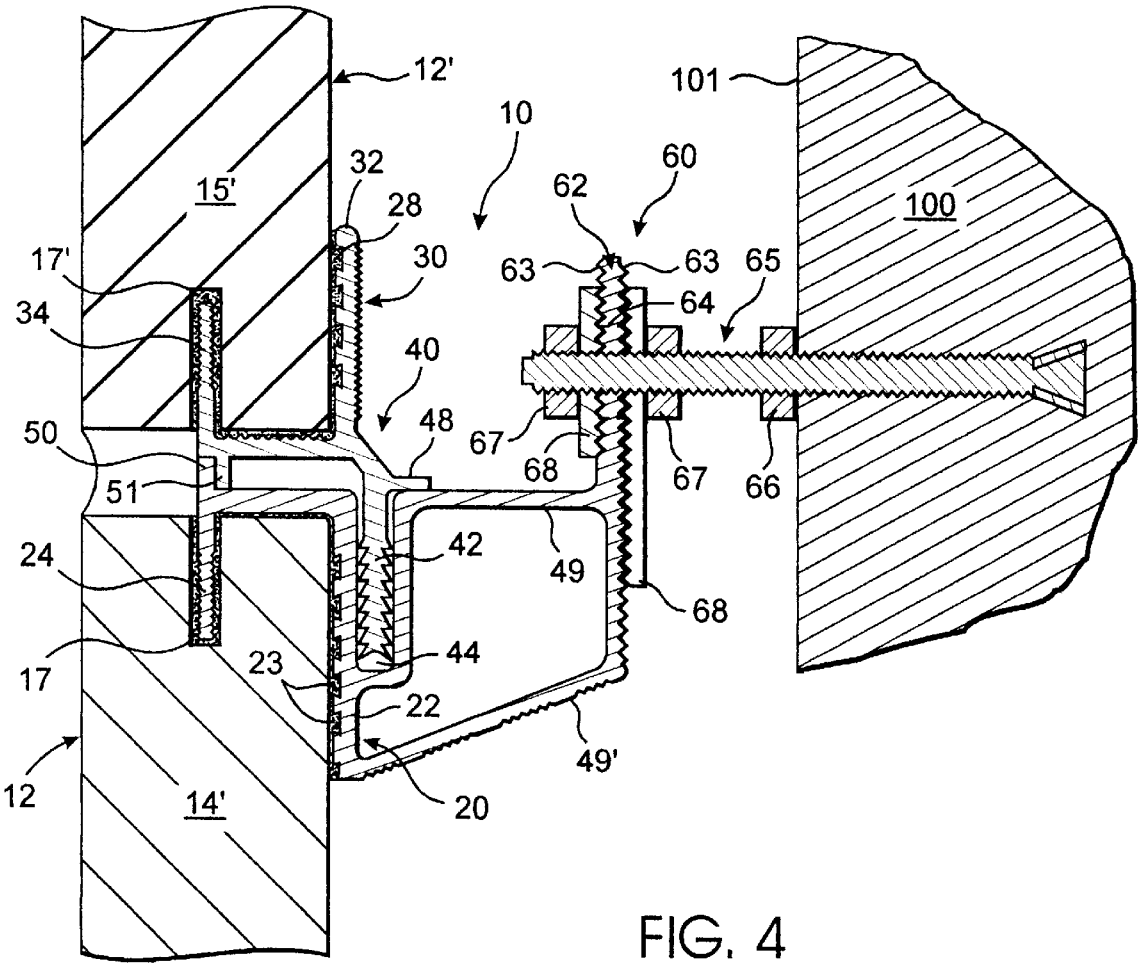
FIG. 4 is a side cross sectional view of the cladding system of the present invention illustrating a preferred embodiment of the mount assembly which secures the cladding system to a building structure.

As seen throughout the Figures, the cladding system 10 preferably includes an upper bracket member 20 and a lower bracket member 30. In particular, the upper bracket member 20 is structured to cooperatively engage a first cladding material panel 12 at generally an upper end 14 thereof. Conversely, the lower bracket member 30 is structured to cooperatively engage a second, preferably adjacently disposed, cladding material panel 12' at generally a lower end 15' thereof. Indeed, as is illustrated by the Figures and as will be explained in better detail subsequently, the upper and lower bracket members 20 and 30, which for purposes of clarity are referred to as a single cladding system 10, support different cladding material panels with bracket members of adjacent cladding systems. For the purposes of clarity, a single cladding system 10 being defined as only a single securement location on the building structure, however, it is understood that at least two and preferably a plurality of the elements described are generally required and may be equally referred to as one overall cladding system structured to secure a plurality of cladding material panels at a plurality of desired locations. Accordingly, as best seen in FIG. 3, the upper bracket member 20 of one cladding system 10 secures the upper end 14 of a cladding material panel 12, while the lower bracket member 30' of another generally adjacently disposed cladding system 10' supports the lower end 15 of that cladding material panel 12, defining an overall integrated system that incorporates a plurality of the individual cladding system 10 units.

Looking specifically to the upper bracket member 20, it is structured to be secured to the building structure in preferably generally spaced apart relation from the surface 101 of the building structure 100, thereby facilitating alignment of the first cladding material panel 12 relative to the surface of the building structure 100, and furthermore in an alternative embodiment permitting the introduction of insulation 55 between the cladding material panel 12 and the surface 101 of the building structure 100. In the preferred embodiment illustrated in the Figures, the upper bracket member 20 includes a substantially strong rigid construction, such as from an aluminum extrusion, and in the preferred embodiment extends along a majority of the upper end 14 of the first cladding material panel 12 so as to achieve a secure hold along the cladding material panel 12. Furthermore, the upper bracket member 20 includes primarily a first fastener member 22 and a second fastener member 24. The first fastener member 22 is structured to supportably engage an interior surface 16 of the first cladding material panel 12 at a point generally adjacent the upper end 14 of the first cladding material panel 12. As illustrated in the Figures, the first fastener member 22 generally extends down a height of the upper end 14 of the first cladding material panel 12 and also preferably extends along a majority of the upper end 14 of the first cladding material panel 12 so as to provide a maximum surface area for engagement with the first cladding material panel 12 and maximum backing support. Although screws, rivets, clips, pegs or other types of fasteners may be utilized so as to secure the first fastener member 22 with the first cladding material panel 12, in the preferred embodiment a strong adhesive material 28, such as a polyurethane or other glue type material is preferably disposed between the first fastener member 22 and the interior surface 16 of the first cladding material 12. Additionally, and as illustrated in the preferred embodiment of the Figures, the engaging surface of the first fastener member 22 which contacts the first cladding material panel 12 is preferably contoured, such as by including a plurality of channels or tracks 23 defined therein. Those contouring tracks 23 maximize a surface area of the first fastener member 22 that contacts the adhesive material and thereby increases a strength of the securement between the first fastener member 22 and the interior surface 16 of the first cladding material panel 12.

The second fastener member 24 of the upper bracket member 20 is structured to extend at least partially into engaging relation with the first cladding material panel 12 at the upper end 14 thereof. In the preferred embodiment, the second fastener member 24 is disposed a spaced apart distance from the first fastener member 22 and actually extends at least partially into a slit 17 defined generally at the upper end 14 of the first cladding material panel 12. In particular, and as illustrated in the Figures, the first and second fastener members 22 and 24 are preferably interconnected with one another by a solid rigid construction so as to define the overall upper bracket member 20. Moreover, the small slit 17 is cut into the first cladding material panel 12 and preferably extends along a majority of the upper end 14 of the first cladding material panel 12 so as to receive the second fastener member 24 therein along the majority of the upper end 14. The second fastener member 24 is preferably provided with a generally striated exterior surface and is to be press fitted within the slit 17 defined in the first cladding material panel 12 so as to maximize a secure engagement therebetween and minimize the risk that the second fastener member 24 will come out of the slit 17. Furthermore, the adhesive material 28 is preferably also disposed within the slit 17 so as to provide for secure engagement between the first cladding material panel 12 and the second fastener member 24. Indeed, it should be noted that this adhesive material 28 preferably extends completely between the surface of the upper bracket member 20 and the end portion of the first cladding material panel 12 which it engages. Furthermore, it is noted that by extending the upper bracket member 20 and in particular the first and second fastener members 22 and 24 along a majority of the upper end 14 of the first cladding material panel 12 a substantially secure support is achieved and cladding material panels of generally thinner construction can be utilized as an increased surface area of support and stability is achieved. Furthermore, as illustrated in the preferred embodiment, the first fastener member 22 is preferably generally longer, extending further down along the upper end 14 of the first cladding material panel 12, than the second fastener member 24. As a result, a primary stress point on the first cladding material panel 12 that is created by forces on the upper bracket member 20 is concentrated closer to a central region of the first cladding material panel 12 wherein a full thickness of the first cladding material 12 provides the resistance to breakage. As further explanation, if the fastener members are provided at substantially the same length down the cladding material panel 12, the stress point will generally be located at a horizontal cross section equivalent with a low point of the slit 17. of course, at the slit the thickness of the cladding material panel 12 is split and only the exterior half of the cladding material panel's 12 thickness resists breakage and/or outward pivotal engagement by the upper bracket member 20 if stresses are urged on the cladding material panel 12. By achieving the longer first fastener member 22 a stress or pivoting break point at which the cladding material panel 12 could snap under severe stresses is concentrated more towards the lower extremity of the first fastener member 22 at which point a full thickness of the cladding material panel 12 is maintained to resist breakage and/or snapping of the cladding material panel 12.

Similarly, the lower bracket member 30 includes a first lower fastener member 32 and a second lower fastener member 34. The first and second lower fastener members 32 and 34 are disposed a spaced apart relation from one another and are generally rigidly interconnected with another as part of the lower bracket member 30, and may include a single aluminum extruded piece. In the preferred embodiment, the first lower fastener member 32 is structured to engage the interior surface 16' of the second cladding material panel 12' at a point generally adjacent the lower end 15' of the second cladding material panel 12'. Furthermore, the adhesive material 28 is preferably disposed between the first lower fastener member 32 and the interior surface 16' of the second cladding material panel 12'. So as to improve the secure engagement the first lower fastener member 32 preferably extends along a majority of the lower end 15' of the second cladding material panel 12' and includes a contoured interior surface 33 with a series of tracks 33 into which the adhesive material may be disposed for a further more secure engagement in the manner previously recited. The second lower fastener member 34 of the lower bracket member 30 is structured to extend into engaging relation with the second cladding material panel 12', preferably into a slit 17' defined at the lower end 15' of the second cladding material panel 12'. The slit 17' is preferably sized to correspond a dimension of the second lower fastener member 34 so as to provide for secure interconnection therebetween. Moreover, the second lower fastener member 34 preferably includes a striated exterior surface so as to resist dislodging or removal from the slit 17', and the adhesive material 28 is further disposed within the slit 17 and preferably between all surfaces of the lower bracket member 30 which come into contact with the second cladding material panel 12'. As with the upper bracket member 20, the lower bracket member 30 also preferably extends along a majority of the lower end 15' of the second cladding material 12', with the first lower fastener member 32 being generally longer than the second lower fastener member 34 in order to extend further up from the lower end 15' of the second cladding material panel 12'. As a result, the lower bracket member 30 more securely supports the second cladding material panel 12', even if the cladding material panel 12' is formed of a generally thinner construction, and a stress or breakpoint is positioned at the lower end 15' of the second cladding material 12' at a point above the slit 17', such that a full thickness of the second cladding material panel 12' at the lower end 15' resists breakage and/or cracking from the stresses of the lower bracket member 30.

As previously discussed, the cladding material panels 12, 12' are often disposed in adjacent very closely spaced relation with one another. In some instances some degree of spacing is desired between the adjacent cladding material panels, however a generally flush or abutted engagement may alternatively be desired. The cladding system 10 of the present invention is structured to accommodate either desired spaced configuration. To this end, the preferred embodiment of the cladding system 10 includes a spacer assembly generally disposed between the upper and lower bracket members 20 and 30 and structured to maintain a desired spacing between the first and second cladding material panels 12 and 12' so as to preserve a desired appearance and so as to prevent pivoting of the first and second cladding material panels 12 and 12' towards one another at the exterior surfaces 13 and 13' thereof. In the preferred embodiment, the spacer element includes one or more rigid supports 50 and 51 disposed in supporting abutting engagement between the upper and lower bracket members 20 and 30. These rigid supports 50 and 51 prevent the upper and lower bracket members 20 and 30 from pivoting towards one another and thereby maintains substantial alignment between the first and second cladding material panels along a vertical plane. Indeed, if such alignment is generally not maintained, unnecessary stresses may result within the slits 17 and 17' of the first and second cladding materials panels 12 and 12', and secure fastening of a cladding system 10' at an opposite end of the cladding material panel may be generally difficult if the uniform vertical plane is not maintained. To this end, it is preferred that the spacer assembly be included whether or not a spacing will be achieved between the first and second cladding material panels 12 and 12'. In the embodiment illustrated in FIG. 1 the spacer assembly generally defines the spacing between the first and second material panel 12 and 12'. Moreover, because of the generally recessed nature of the positioning of the spacer assembly, the cladding system 10 is generally concealed and is not visible from an exterior of the first and second cladding material panels 12 or 12'. Of course, a layer or grout or caulk may be disposed in the space if so desired for the required finish. Alternatively, and as illustrated in FIG. 2, when a general abutting engagement between the first and second cladding material panels 12 and 12' is desired, the spacer assembly is still preferably incorporated. In this embodiment, however, a leg 18' at the lower end 15' of the second cladding material 12' is preferably shortened such that the exterior surface 13' of the lower end 15' of the second cladding material panel 12' overhangs the lower bracket member 30 and eliminates the spacing between the first and second cladding material panels 12 and 12' to a desired amount.

The cladding system 10 of the present invention further includes a coupling assembly, generally indicated as 40. The coupling assembly 40 is structured to secure the upper and lower bracket members 20 and 30 in substantially aligned relation with one another such that the exterior surfaces 13 and 13' of the first and second cladding material panels 12 and 12' are generally aligned with another and a substantially uniform exterior appearance of the overall structure is maintained. Moreover, in the preferred embodiment of the present invention, the coupling assembly is generally structured so as to secure the upper and lower bracket members 20 and 30 generally with a single mount assembly 60, to be described in further detail subsequently, which is fastened to the building structure 100. Looking further to the preferred embodiment of the coupling assembly 40, it preferably includes a retention channel 44 and a lock segment 42 structured to cooperatively engage one another. It is noted that in the preferred embodiment, the lock segment 42 generally extends from the lower bracket member 30, while the retention channel 44 is generally associated with the upper bracket member 20. Of course, opposing association of the retention channel and lock segment with the upper and lower bracket members 20 and 30 could also be provided, if desired. The illustrated preferred embodiment is, however, desirable such that the effects of gravity further assist the secure interconnection therebetween. As illustrated, the retention channel 44 and lock segment 42 preferably extend along a majority of the cladding system 10 and along substantially a majority of the upper and lower ends of the cladding material panels 12, 12' to which the cladding assembly 10 is secured, although segmented construction is contemplated. To this end, secure engagement between the upper and lower bracket members 20 and 30 is generally achieved throughout. Also, as illustrated in the Figures, the coupling assembly 40, and preferably the lock segment 42, preferably includes a retention flange 48. In particular, the lock segment 42 generally dependents downwardly from the lower bracket member 30 with the retention flange 48 extending into abutting engagement with a rigid structure, preferably associated with the upper bracket member 20. As a result, the retention flange 48 is structured to resist pivotal disengagement between the lock segment 42 and the retention flange 44 such that a generally aligned coupled engagement between the upper and lower bracket members 20 and 30 is maintained by the coupling assembly 40. Indeed, it is noted that in the preferred embodiment which includes the spacer assembly, the spacer assembly and the coupling assembly 40 generally work with one another so as to maintain effective spacing and maintain general alignment and a uniform vertical plane between adjacent cladding material panels 12, 12'. Also as illustrated in the Figures, a depth adjustment element 47 may be provided within the retention channel 44 so as to vary a depth to which the lock segment 42 extends. As a result, the depth adjustment element 47 helps to ensure a secure engagement and a supported retention of the lock segment 42 within the retention channel 44, while permitting appropriate spacing adjustment as desired between the upper and lower bracket members 20 and 30. Moreover, the lock segment 42 preferably includes a generally striated exterior surface which in cooperation with a properly sized retention channel 44 and preferably an adhesive material within the retention channel 44 helps to ensure secure retention of the lock segment 42 within the retention channel 44 and facilitate depth variation as well.

Accordingly, from the proceeding it is seen that substantial facilitated securement of the first and second cladding material panels 12 and 12' can be achieved especially as the result of the coupling assembly 40. In particular, the upper bracket member 20 can be correspondingly secured to a first cladding material panel 12 and can be mounted to the building structure 100. At that point, the lower bracket member 30 can be independently secured to the second cladding material 12', with the entire structure including the secured lower bracket member 30 and second cladding material 12' being lowered and/or positioned in place into engagement with the upper bracket member 30 by the coupling assembly 40. As a result, a substantially secure and stable interconnected engagement is achieved without requiring independent mounting or securing of the upper and lower bracket members 20 and 30 to the building structure 100, and in a manner which maintains substantial alignment, stability and security along the confronting surfaces of the first and second cladding material panels 12 and 12'.

As previously recited, the lower bracket member 30 is preferably supportably retained by a mount assembly 60 of the present invention through the coupling assembly 40, thereby ensuring that both the upper and lower bracket members 20 and 30 are secured to the surface 101 of the building structure 100 by the single mount assembly 60. Such an interconnected and single fastening point ensures secure and aligned positioning of the first and second cladding material panels 12 and 12' relative to one another and minimizes an installation time associated with securement of both the upper and lower bracket members 20 and 30 to the building structure 100. To this end, it is preferred that the first and second cladding material 12 and 12' be disposed a generally spaced apart distance from the surface 101 of the building structure 100. In particular, such a spacing permits the introduction of insulation 55 and/or the mere presence of an air pocket insulation between the first and second cladding material panels 12 and 12' and the surface 101 of the building structure 100. In order to securely and stably maintain that spaced fastening between the upper and lower bracket members 20 and 30 and the building structure 100 the mount assembly 60 of the present invention preferably includes a spacer structure. The spacer structure preferably includes a rigid framework, such as including extruded members 49 and 49' which extend from and may be integrated with the upper bracket member 30, that maintains secure engagement with a remainder of the mount assembly 60. As illustrated, the retention flange 48 of the coupling assembly 40 preferably abuts an upper of the members 49. Moreover, the spacer structure is preferably of a generally hollow tubular configuration so as to minimize an overall weight of the cladding system, while still providing for substantially strength and security. Indeed, these elements as well as all the remaining elements are preferably formed of an extruded metal, such as aluminum, with the thickness thereof varying according to the design desired and/or the strength requirements of a user or manufacturer.

Turning specifically to the mount assembly 60, it is structured to be secured to the building structure 100 such that the overall cladding system 10 is securely and stably positioned. In the preferred embodiment, the mount assembly 60 includes a preferably elongate mount flange 62. The mount flange 62 extends along a majority of the first and second cladding material panels 12, 12' and provides a number of attachment points at which the cladding system 10 is secured to the building structure 100. To this end, the mount assembly 60 further includes at least one, but preferably a plurality of mount elements 65 secured to and extending from the surface 101 of the building structure 100. In the preferred embodiment, the mount elements 65 include a series of elongate bolts which are secured and driven into the building structure 100 and protrude from the surface 101 of the building structure 100 for securement with the mount flange 62 of the mount assembly 60. Of course, a variety of other fasteners may be utilized to define the mount element.

The mount flange 62 preferably includes a plurality of mount apertures 64 through which the mount elements 65 extend for secure coupled interconnection therebetween. Furthermore, more mount apertures 64 than required for a particular fastening may be provided so as to permit variation in a fastening point if a particular portion of the building structure 100 is not optimal for securement. Also, in the preferred embodiment the mount aperture 64 includes a diameter that is larger than the exterior diameter of the mount element 65. As a result, the mount flange 62 can be adjustability mounted in a vertical plane relative to the secured mount element 65. This is especially beneficial so as to accommodate for adjustment requirements between adjacent cladding systems 10 that become evident during mounting. Moreover, in cases where a certain portion of the building 100 represent a weak area and the mount element 65 cannot be ideally driven therein or cannot be preferably aligned with the mount aperture 64 when driven, a variation of the position of the mount flange 62 on the mount element 65 and the inclusion of surplus mount apertures 64 provide an optimal solution.

Still, however, it is required that a secure and stable interconnection be ultimately achieved between the mount flange 62 and the mount element 65. To this end, a pair of spaced apart fastener assemblies are disposed on opposite sides of the mount flange 62, at the mount aperture 64, and are structured to secure the mount flange 62 in generally sandwiched and secure relation therebetween and to the mount element 65. In the preferred embodiment at least one but preferably both of the fastener assemblies include a pair of opposing bolts 67 which ride on the mount elements 65, and preferably corresponding washers 68 which confront and engage the mount flange 62. As such, tightening of the bolts 67 provides for the secure sandwiched fastening of the mount flange 62 therebetween and to the mount element 65 on which the bolts 67 ride. Moreover, so as to facilitate the variable vertical positioning of the mount flange 62 on the mount element 65, especially in light of the larger diameter mount aperture 64, yet so as to achieve a secure and stable engagement when ultimate fastening is achieved, the mount flange 62 preferably includes at least one but preferably both surfaces 63 which confront the washer 68 of a generally striated configuration. Indeed, this striated configuration corresponds preferably an at least partially striated configuration on each of the confronting surfaces of the washers 68. As a result, when secure sandwiched tightening of the washers 68 about the mount flange 62 is achieved, the mating striated surfaces prevents slippage and/or sliding along a vertical plane and maintains the mount flange 62 secured to the mount element 65 regardless of whether a surface of the mount element 65 is abutting the mount flange 62 itself.

Furthermore, it is noted that the mount assembly 60 is structured to variably position the spacing of the first and second cladding material panels 12 and 12' relative to the surface 101 of the building structure 100. Such a variable spacing is particularly beneficial if an uneven surface 101 of the building structure 100 is present between fastening locations. To this end, the fastener assemblies are preferably adjustable along a length of the mount elements 65 such that the mount flange 62 can be positioned at any desired spacing, with the bolts 67 securing the mount flange 62 to the mount element 65 at that desired spacing relative to the surface 101 of the building structure 100. Also, preferably an additional bolt 66 or like element is provided so as to further secure and fasten the mount element 65 to the building structure 100 while permitting independent variable securement and positioning of the mount flange 62 at any protruding portions of the mount element 65.

Figure 2:
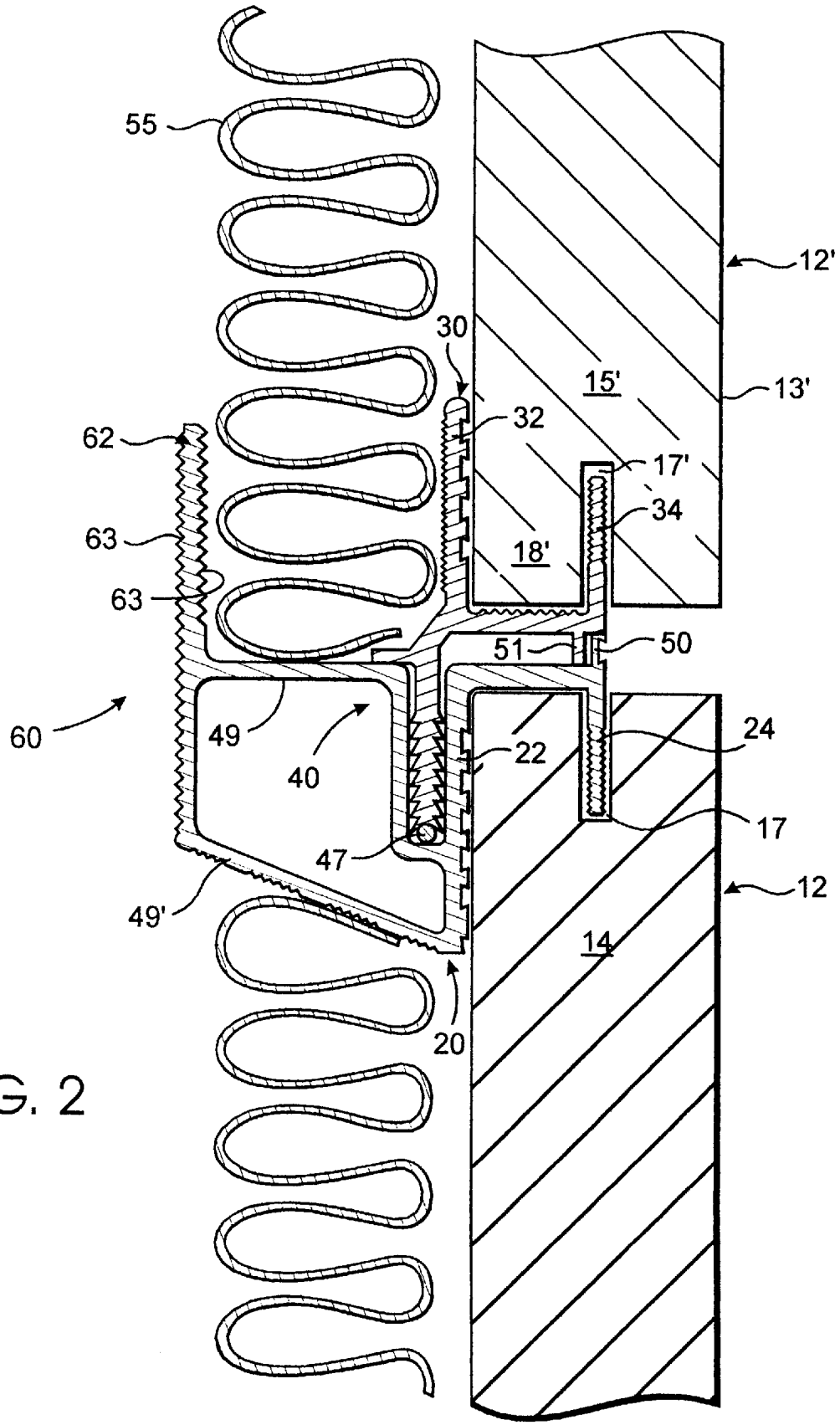
FIG. 2 is a side cross sectional view of the cladding system of the present invention incorporating the use of insulation and providing generally for abutment between adjacent cladding material panels.

Lastly, as illustrated in FIG. 1, in an alternative embodiment of the cladding system 10 of the present invention a flexible material panel 70 may be provided and secured to the mount assembly 60, and particularly the mount flange 62, as well as to the interior surface 16 of the first cladding material panel 12. In particular, the flexible material panel 70 may be of a mesh or other secure generally tear resistent configuration and is preferably adhered to the first cladding material panel 12 by an adhesive, such as the adhesive material 28 used throughout the cladding system 10. As a result, in certain environments, such as earthquakes or hurricane type of environments, this flexible material panel 70 provides an added layer of security and fastening between the first cladding material panel 12 and the cladding system 10.

Since many modifications, variations and changes in detail can be made to the described preferred embodiment of the invention, it is intended that all matters in the foregoing description and shown in the accompanying drawings be interpreted as illustrative and not in a limiting sense. Thus, the scope of the invention should be determined by the appended claims and their legal equivalents.

Now that the invention has been described,

What is claimed is:

1. To secure at least a first and a second cladding material panel to a surface of a building structure, a cladding system comprising:

an upper bracket member structured to cooperatively engage an upper end of a first cladding material panel, said upper bracket member structured to be secured to the building structure in generally spaced apart relation from said surface of said building structure so as to facilitate alignment of said first cladding material panel;

a mount assembly structured to secure said upper bracket member to said surface of said building structure in an aligned manner;

a lower bracket member structured to cooperatively engage a lower end of a second cladding material panel disposed in generally adjacent relation above said first cladding material panel; and a coupling assembly structured to secure said upper and said lower bracket members in substantially aligned relation with one another such that an exterior surface of said first cladding material panel secured by said upper bracket member is generally aligned with an exterior surface of said second cladding material panel secured by said lower bracket member;

said coupling assembly including a retention channel and a lock segment structured to cooperatively engage one another so as to generally secure said upper and lower bracket members in aligned relation with one another and with said mount assembly, and thereby secure said first and said second cladding material panels in aligned relation with one another; and a depth adjustment element disposed in said retention channel and structured to vary a depth to which said lock segment extends into said retention channel.

2. A cladding system as recited in claim 1 wherein said upper and said lower bracket members are generally elongate and extend substantially along a majority of said respective upper and lower ends of said first and second cladding material panels so as to substantially securely support said first and second cladding material panels and permit said first and said second cladding material panels to be of a generally thin construction.

3. A cladding system as recited in claim 1 further comprising a spacer assembly disposed between said upper and said lower bracket members and structured to maintain a space between said first and said second cladding material panels and to maintain alignment between said first and second cladding material panels by preventing pivoting thereof towards one another at said exterior surfaces thereof.

4. A cladding system as recited in claim 3 wherein said spacer assembly is generally recessed from said exterior surface of said first and second cladding material panels so as to be generally concealed while maintaining said space and said alignment between said first and second cladding material panels.

5. A cladding system as recited in claim 4 wherein said spacer assembly includes at least one rigid support segment disposed between said upper and lower bracket members.

6. A cladding system as recited in claim 1 wherein said lock segment includes an at least partially striated exterior surface so as to be securely retained within said retention channel as so as to facilitate variation in a depth to which said lock segment extends into said retention channel.

7. A cladding system as recited in claim 1 wherein said lock segment further includes a retention flange structured to restrict pivotal disengagement between said lock segment and said retention channel.

8. A cladding system as recited in claim 1 wherein said lock segment depends downwardly from said lower bracket member and said retention channel is operatively coupled with said upper bracket member and structured and disposed to receive said lock segment in secure mating engagement therein.

9. A cladding system as recited in claim 1 wherein said upper bracket member includes a first fastener member and a second fastener member, said first fastener member being structured to supportably engage an interior surface of the first cladding material panel at a point generally adjacent said upper end thereof, and said second fastener member being disposed a spaced apart distance from said first fastener member, and being structured to extend at least partially into engaging relation with said first cladding material panel at said upper end thereof.

10. A cladding system as recited in claim 9 wherein an engaging surface of said first fastener member is structured to be secured to said interior surface of said first cladding material panel by an adhesive material.

11. A cladding system as recited in claim 10 wherein said engagement surface of said first fastener member is generally contoured so as to maximize a surface area which engages said adhesive material and thereby increase a strength of a securement with said interior surface of said first cladding material panel.

12. A cladding system as recited in claim wherein said first fastener member extends along a majority of said upper end of said first cladding material panel so as to substantially securely support said first cladding material panel and permit said first cladding material panel to be of a generally thin construction.

13. A cladding system as recited in claim 12 wherein said second fastener member extends at least partially into a slit defined in said upper end of said first cladding material panel.

14. A cladding system as recited in claim 13 wherein said second fastener member is secured in said slit by an adhesive material.

15. A cladding system as recited in claim 13 wherein said second fastener member and accordingly said slit in said upper end of said first cladding material panel extends along said majority of said upper end of said first cladding material panel so as to substantially securely support said first cladding material panel and permit said first cladding material panel to be of said generally thin construction.

16. A cladding system as recited in claim 13 wherein said first fastener member is generally longer than said second fastener member such that a primary stress point on said first cladding material panel created by said upper bracket member is concentrated closer to a central region of said first cladding material panel wherein a full thickness of said first cladding material panel provides resistance to breakage.

17. A cladding system as recited in claim 1 wherein said lower bracket member includes a first lower fastener member and a second lower fastener member, said first lower fastener member being structured to supportably engage said interior surface of the second cladding material panel at a point generally adjacent said lower end thereof, and said second lower fastener member being disposed a spaced apart distance from said first lower fastener member, and being structured to extend at least partially into engaging relation with said second cladding material panel at said lower end thereof.

18. A cladding system as recited in claim 17 wherein said first lower fastener member extends along a majority of said lower end of said second cladding material panel so as to substantially securely support said second cladding material panel and permit said second cladding material panel to be of a generally thin construction.

19. A cladding system as recited in claim 18 wherein said second lower fastener member extends at least partially into a slit defined in said lower end of said second cladding material panel.

20. A cladding system as recited in claim 19 wherein said second lower fastener member and accordingly said slit in said lower end of said second cladding material panel extends along said majority of said lower end of said second cladding material panel so as to substantially securely support said second cladding material panel and permit said second cladding material panel to be of said generally thin construction.

21. A cladding system as recited in claim 17 wherein said first lower fastener member is generally longer than said second lower fastener member such that a primary stress point on said second cladding material panel created by said lower bracket member is concentrated closer to a central region of said second cladding material panel wherein a full thickness of said second cladding material panel provides resistance to breakage.

22. A cladding system as recited in claim 1 wherein said lower bracket member is supportably engaged by said mount assembly through said coupling assembly such that both said upper and said lower bracket members are secured to said surface of said building structure by said mount assembly, thereby ensuring secure, facilitated and aligned positioning of said first and said second cladding material panels relative to one another and relative to said surface of said building structure and minimizing an installation time associated with a securement of both said upper and lower bracket members to said building structure.

23. A cladding system as recited in claim 22 wherein said mount assembly includes a spacer structure structured to secure said upper and said lower bracket members in said spaced apart distance from said surface of said building structure.

24. A cladding system as recited in claim 23 wherein said spacer structure is structured and disposed to facilitate introduction of a quantity of insulation material between said first and said second cladding material panels and said surface of said building structure.

25. A cladding system as recited in claim 1 wherein said mount assembly includes a mount flange structured to be fastened to said surface of said building structure.

26. A cladding system as recited in claim 25 wherein said mount flange is generally elongate and extends along a majority of said first and said second cladding material panels.

27. A cladding system as recited in claim 26 wherein said mount assembly further includes a mount element secured to and structured to extend from said surface of said building structure.

28. A cladding system as recited in claim 27 wherein said mount element is structured to be adjustably coupled to said mount flange so as to vary a spacing between said mount flange and said surface of said building structure and thereby accommodate varying contours in said surface of said building structure.

29. A cladding system as recited in claim 28 including a plurality of said mount elements.

30. A cladding system as recited in claim 28 wherein said mount flange includes a mount aperture through which said mount element extends for securement to said mount flange.

31. A cladding system as recited in claim 30 wherein said mount aperture is of a larger diameter than an exterior diameter of said mount element so as to permit variation in a position of said mount flange on said mount element.

32. A cladding system as recited in claim 31 wherein said mount element includes a pair of spaced apart fastener assemblies disposed on opposite sides of said mount flange at said mount aperture and structured to secure said mount flange in sandwiched relation therebetween and to said mount element.

33. A cladding system as recited in claim 32 wherein said mount flange and at least one of said fastener assemblies include at least partially striated mating surfaces so as to prevent relative slippage between said mount flange and said fastener assemblies upon being secured with one another.

34. A cladding system as recited in claim 32 wherein each of said fastener assemblies is variably positionable along a length of said mount element so as to vary said spacing between said mount flange and said surface of said building structure.

35. A cladding system as recited in claim 1 further comprising a flexible material panel secured to said first cladding material panel and said mount assembly so as to further secure said first cladding material panel to said building structure.

36. To secure at least a first and a second cladding material panel to a surface of a building structure, a cladding system comprising:

an upper bracket member structured to cooperatively engage an upper end of a first cladding material panel;

a lower bracket member structured to cooperatively engage a lower end of a second cladding material panel disposed in generally adjacent relation above said first cladding material panel; and a coupling assembly including a retention channel and a lock segment structured to cooperatively engage one another so as to generally secure said upper and lower bracket members in aligned relation with one another, and thereby secure said first and said second cladding material panels in generally aligned relation with one another;

a depth adjustment element disposed in said retention channel and structured to vary a depth to which said lock segment extends into said retention channel; and a mount assembly structured to secure said upper and said lower bracket members to said surface of said building structure in an aligned manner.

37. To secure at least a first and a second cladding material panel to a surface of a building structure, a cladding system comprising:

an upper bracket member structured to cooperatively engage an upper end of a first cladding material panel;

a lower bracket member structured to cooperatively engage a lower end of a second cladding material panel disposed in generally adjacent relation above said first cladding material panel; and a coupling assembly structured to secure said upper and said lower bracket members in substantially aligned relation with one another such that an exterior surface of said first cladding material panel secured by said upper bracket member is generally aligned with an exterior surface of said second cladding material panel secured by said lower bracket member;

a mount assembly structured to secure said upper and said lower bracket members to said surface of said building structure in an aligned manner; and a spacer assembly disposed between said upper and said lower bracket members and structured to maintain a space between said first and said second cladding material panels and to maintain alignment between said first and second cladding material panels by preventing pivoting thereof towards one another at said exterior surfaces thereof.

38. To secure at least a first and a second cladding material panel to a surface of a building structure, a cladding system comprising:

an upper bracket member structured to cooperatively engage an upper end of a first cladding material panel;

a lower bracket member structured to cooperatively engage a lower end of a second cladding material panel disposed in generally adjacent relation above said first cladding material panel; and a coupling assembly structured to secure said upper and said lower bracket members in substantially aligned relation with one another such that an exterior surface of said first cladding material panel secured by said upper bracket member is generally aligned with an exterior surface of said second cladding material panel secured by said lower bracket member;

a mount assembly structured to secure said upper and said lower bracket members to said surface of said building structure in an aligned manner; and a spacer assembly disposed between said upper and said lower bracket members and structured to maintain a space between said first and said second cladding material panels; and said spacer assembly including at least one rigid support segment disposed between confronting upper and lower ends of the first and second cladding material panels.

* * * * *